US005455663A

United States Patent [19]

Inoue et al.

[11] Patent Number: 5,455,663

[45] Date of Patent: Oct. 3, 1995

[54] IMAGE FORMING APPARATUS INCLUDING RECORDING MATERIAL CARRYING MEANS

[75] Inventors: Masahiro Inoue, Kawasaki; Nobuhiko Takekoshi, Yokohama, both of Japan

[73] Assignee: Canon Kabushiki Kaisha, Tokyo, Japan

[21] Appl. No.: 263,490

[22] Filed: Jun. 21, 1994

Related U.S. Application Data

[63] Continuation of Ser. No. 774,329, Oct. 10, 1991, abandoned.

[30] Foreign Application Priority Data

Oct. 13, 1990 [JP] Japan ..... 2-273918
Sep. 2, 1991 [JP] Japan ..... 3-221572

[51] Int. Cl.[6] ..... G03G 15/14

[52] U.S. Cl. ..... 355/271; 271/7; 271/150; 355/272; 355/274; 355/327

[58] Field of Search ..... 271/3, 3.1, 6, 7, 271/34, 150, 225; 355/208, 271, 272, 274, 275, 277, 281, 326, 327

[56] References Cited

U.S. PATENT DOCUMENTS

| | | | |
|---|---|---|---|
| 4,371,253 | 2/1983 | Day et al. | 355/77 X |
| 4,660,077 | 4/1987 | Kawamura et al. | 358/75 |
| 4,708,457 | 11/1987 | Shimura et al. | 355/274 |
| 4,796,047 | 1/1989 | Fowlkes et al. | 355/277 |
| 4,873,541 | 10/1989 | Hirose et al. | 346/160.1 |
| 4,903,067 | 2/1990 | Murayama et al. | 355/271 X |
| 4,952,978 | 8/1990 | Ueda et al. | 355/245 |
| 4,978,998 | 12/1990 | Aizawa | 355/273 |
| 5,043,771 | 8/1991 | Shibata et al. | 355/208 X |
| 5,053,826 | 10/1991 | Castelli et al. | 355/271 |
| 5,091,751 | 2/1992 | Inoue et al. | 355/274 |

*Primary Examiner*—Leo P. Picard
*Assistant Examiner*—Christopher Horgan
*Attorney, Agent, or Firm*—Fitzpatrick, Cella, Harper & Scinto

[57] ABSTRACT

An image forming apparatus includes a cylindrical image bearing member, an image forming device for forming an image on the image bearing member, a transfer unit for performing first image transfer of the image on the image bearing member to a recording material at a transfer position, and a movable recording material carrying unit for conveying the recording material to the transfer position while carrying the recording material in order to perform the first image transfer. The recording material carrying unit further carries and conveys the recording material in order to perform second image transfer to the recording material after the first image transfer. The apparatus also includes a conveying unit for conveying the recording material to the recording material carrying unit. The recording material is first conveyed by the conveying unit to a position within the radius R of the image bearing member at the upstream side in a moving direction of the recording material carrying unit from the transfer position on the recording material carrying unit.

22 Claims, 6 Drawing Sheets

IMAGE FORMING APPARATUS INCLUDING RECORDING MATERIAL CARRYING MEANS

This application is a continuation of application Ser. No. 07/774,329, filed Oct. 10, 1991, now abandoned.

BACKGROUND OF THE INVENTION

1. Title of the Invention

This invention relates to an image forming apparatus which forms images on image bearing members and transfers the images onto a recording material conveyed by a recording material carrying means. The present invention can be suitably applied, for example, to an electrophotographic image forming apparatus, and particularly to a color electrophotographic copier which forms images having different colors on a plurality of image bearing members, such as electrophotographic photosensitive members, and sequentially transfers the respective images to the same recording material, superposing the images.

2. Description of the Related Art

There are known various kinds of color image forming apparatuses wherein a plurality of image forming units are provided, toner images having different colors are formed in the respective image forming units, and the toner images are sequentially transferred and superimposed onto the same recording material. Mostly used among them are color copiers using multicolor electrophotography.

An example of the aforementioned color electrophotographic copiers will be briefly explained with reference to FIG. 5. First, second, third and fourth image forming units Pa, Pb, Pc and Pd are provided within the main body of a color electrophotographic copier. The image forming units Pa, Pb, Pc and Pd include respective dedicated image bearing members; electrophotographic photosensitive drums 1*a*, 1*b*, 1*c* and 1*d* in the present example.

Latent image forming units 2*a*, 2*b*, 2*c* and 2*d*, developing units 3*a*, 3*b*, 3*c* and 3*d*, and cleaning units 5*a*, 5*b*, 5*c* and 5*d* are disposed near respective outer circumferences of the photosensitive drums 1*a*, 1*b*, 1*c* and 1*d*.

A recording material conveying belt 8 is disposed beneath the image forming units Pa, Pb, Pc and Pd. Transfer units 4*a*, 4*b*, 4*c* and 4*d*, each provided with a charger for transfer, are disposed inside the enclosed loop of recording material conveying belt 8.

In this configuration, a latent image corresponding to a cyan-component color in the image of an original is formed on the photosensitive drum la of the first image forming unit Pa by the latent image forming unit 2*a*. The latent image is made visible image using a developer comprising cyan toner contained in the developing unit 3*a*. The cyan-toner image is transferred to a recording material 6 comprising a paper-like sheet conveyed from a recording material cassette 60 by the conveying belt 8 via registration rollers 13 in the transfer unit 4*a*.

As the cyan-toner image is transferred to the recording material 6 as described above, a latent image corresponding to a magenta-component color in the image of the original is formed on photosensitive drum 1*b* in the second image forming unit Pb. A magenta-toner image formed on photosensitive drum 1*b* by the developing unit 3*b* is transferred to a predetermined position on the recording material 6 when the recording material 6 on which the image transfer in the first image forming unit Pa has been completed is conveyed to the transfer unit 4*b* by the conveying belt 8.

Subsequently, a yellow-toner image and a black-toner image are formed in the third and fourth image forming units Pc and Pd, respectively, in the same manner as described above. The yellow-toner image and the black-toner image are superimposed to the predetermined position on the above-described recording material 6 carried by the conveying belt 8.

After the completion of the above-described image forming processes, the respective toner images on the recording material 6 are fused together and fixed on the recording material 6 by a fixing unit 7, and thus a full-color image is obtained. After the completion of the transfer, toner particles remaining on the photosensitive drums 1*a*, 1*b*, 1*c* and 1*d* are removed by the cleaning units 5*a*, 5*b*, 5*c* and 5*d* so that the photosensitive drums are ready for the next latent image formation.

When the conveying belt 8 starts to rotate, the recording material 6 is conveyed onto the belt 8 via the registration rollers 13. At that time, an image writing signal is turned on, and image formation is performed at a predetermined timing on the photosensitive drum 1*a* for the first color. When the recording material 6 is conveyed to the contact portion (the transfer position) of the photosensitive drum 1*a* and the conveying belt 8, the toner image on the photosensitive drum 1*a* is transferred onto the recording material 6. At that time, the electrostatic attraction of recording material 6 to the conveying belt 8 is high due to a voltage applied to the charger for transfer.

In some cases, however, the front end of recording material 6 is floating when it is fed onto the conveying belt 8. Hence, particularly when a recording material having strong stiffness, such as with cardboard, or having a curled recording material is used, the front end of the recording material may not adhere sufficiently to the conveying belt, causing insufficient transfer, the front end of the recording material may be bent, or a sufficient retention force on the conveying belt may not be obtained after transfer of the first-color image, causing paper jamming or paper folding when starting transfer of the second-color image.

SUMMARY OF THE INVENTION

The present invention has been made in consideration of the above-described problems.

It is an object of the present invention to provide an image forming apparatus which performs a plurality of high quality transfer operations on a recording material while preventing insufficient attraction and insufficient conveyance of the recording material carried by a recording material carrying means.

It is another object of the present invention to provide an image forming apparatus which suppresses floating of the front end of a recording material on a recording material carrying means.

It is still another object of the present invention to provide an image forming apparatus which prevents insufficient transfer of an image by excellently carrying a recording material by a recording material carrying means.

In accordance with the above objects, there is provided an image forming apparatus with a cylindrical image bearing member, an image forming means for forming an image on the image bearing member, transfer means for performing a first image transfer of the image on the image bearing member to a recording material at a first transfer position, a movable recording material carrying means for conveying the recording material to the first transfer position for performance of the first image transfer and then for conveying the recording material to a second transfer position for performance of a second image transfer, and a conveying means for conveying the recording material to the recording material carrying means, the recording material being first conveyed by the conveying means to a position upstream of the transfer position by a distance less than the radius R of the cylindrical image bearing member.

In yet another aspect of the present invention there is provided an image forming apparatus having the above-described cylindrical image bearing member, image forming means, transfer means, movable recording material carrying means and conveying means, and further including a pressing means for pressing the recording material carrying means at the transfer position from a side opposite to the image bearing member.

These and other objects and features of the present invention will become more apparent from the following detailed description of the preferred embodiments taken in connection with the accompanying drawings.

DETAILED DESCRIPTION OF THE PREFERRED EMBODIMENTS

An image forming apparatus according to an embodiment of the present invention will now be explained in detail with reference to the drawings.

Figure 3:
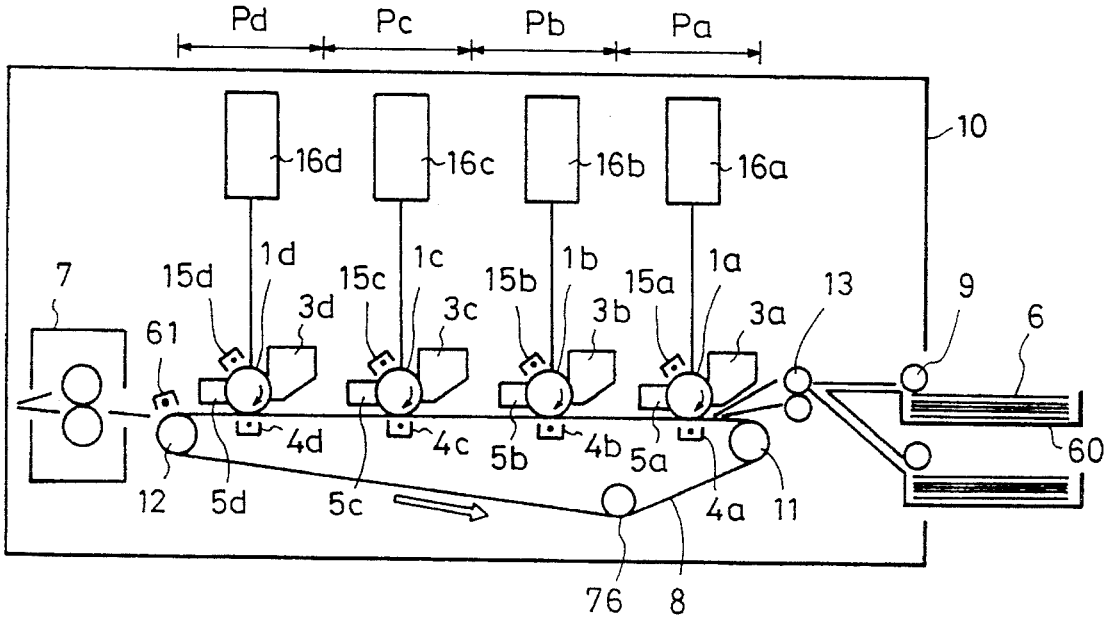
FIGS. 3, 4, 7 and 8 are side cross-sectional views of image forming apparatuses according to embodiments of the present invention.
Figure 5:
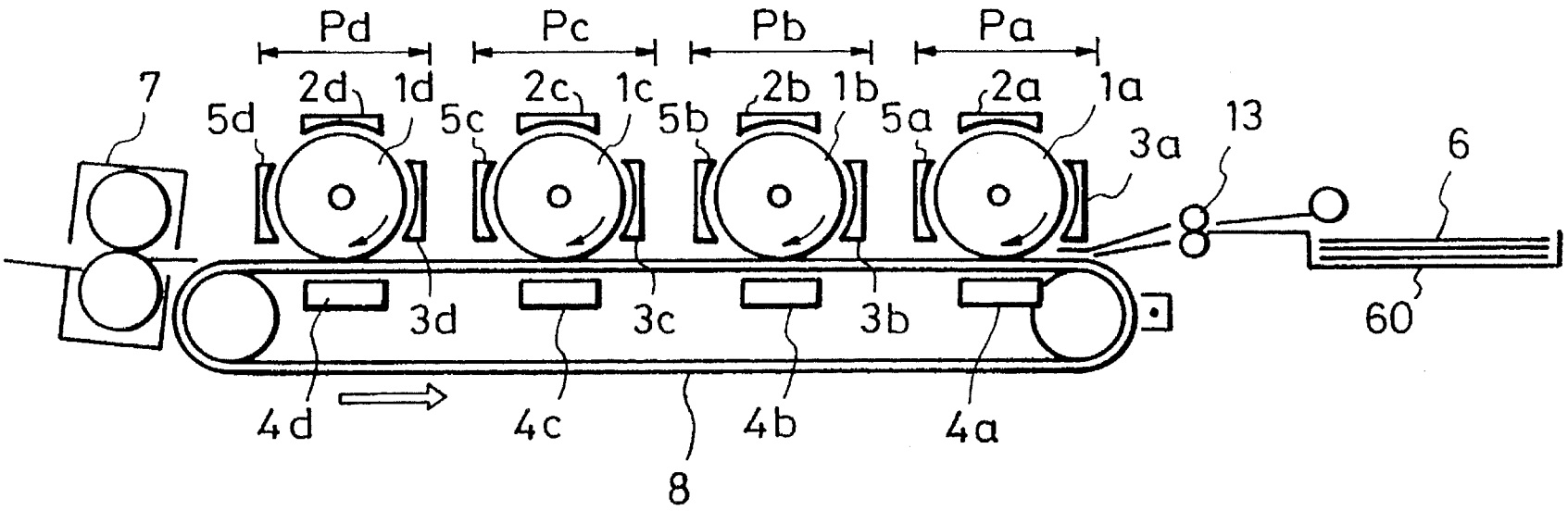
FIG. 5 PRIOR ART
FIG. 5 is a side cross-sectional view of a conventional image forming apparatus.

FIG. 3 is a side cross-sectional view of a color electrophotographic printer, serving as an image forming apparatus according to an embodiment of the present invention. In FIG. 3, the same components as those in FIG. 5 are indicated by the same reference numerals.

Image forming units Pa, Pb, Pc and Pd are disposed within the main body 10 of the image forming apparatus. An endless conveying belt 8 is wound around driving roller 12, driven supporting roller 11 and tension roller 76, and serves a recording material carrying means. The endless conveying belt 8 is provided beneath the above-described image forming units. The conveying belt 8 is rotated in the direction of the arrow. The conveying belt 8 comprises a flexible dielectric resin sheet, such as a polyethylene terephthalate resin sheet, a polyvinylidene fluoride resin sheet, a polyurethane resin sheet or the like. A seamless belt may also be used as the conveying belt 8.

Registration rollers 13, serving as conveying means for conveying a recording material to the recording material carrying means, are disposed at the paper-feeding side of the conveying belt 8.

The first, second, third and fourth image forming units Pa, Pb, Pc and Pd disposed above the conveying belt 8 include photosensitive drums 1*a*, 1*b*, 1*c* and 1*d*, respectively. As shown in FIG. 3, chargers 15*a*, 15*b*, 15*c* and 15*d* are disposed at the upper left sides of the photosensitive drums 1*a*, 1*b*, 1*c* and 1*d*, respectively.

Laser-beam scanners 16*a*, 16*b*, 16*c* and 16*d* are disposed above the photosensitive drums 1*a*, 1*b*, 1*c* and 1*d*, respectively. Each of these laser-beam scanners 16*a*, 16*b*, 16*c* and 16*d* comprises a semiconductor laser, a polygon mirror, an f-θ lens and the like, and is configured so as to receive an electric digital image signal input and expose each of the photosensitive drums 1*a*, 1*b*, 1*c* and 1*d* by scanning with a laser beam modulated in accordance with the signal in the direction of the generatrix of each drum between each of the chargers 15*a*, 15*b*, 15*c* and 15*d* and developing units 3*a*, 3*b*, 3*c* and 3*d*.

The recording material conveying belt 8 is disposed beneath the image forming units Pa, Pb, Pc and Pd, and corona chargers 4*a*, 4*b*, 4*c* and 4*d* for transfer, each comprising a wire electrode and a shield electrode, and serving as transfer means for transferring a toner image on the photosensitive drum to a recording material, are disposed within the conveying belt 8.

First, the photosensitive drum 1*a* of the first image forming unit Pa is charged by the charger 15*a*, and a latent image corresponding to a cyan-component color image of an original is formed by irradiation from laser-beam scanner 16*a*. The latent image is made visible using a cyan toner developer contained in the developing unit 3*a*. The cyan-toner image is transferred to a recording material 6 comprising a paper-like sheet by means of transfer unit 4*a* having a charger for transfer. Recording material 6 is conveyed from a recording material cassette 60 by the conveying belt 8 via registration rollers 13.

As recording material 6 is conveyed onto the conveying belt 8, an image writing signal is turned on, and image formation on the photosensitive drum 1*a* for the first color takes place at a predetermined timing. When the recording material 6 is conveyed to the contact portion of the photosensitive drum la to the conveying belt 8 (i.e., the transfer position), the toner image on the photosensitive drum 1*a* begins transferring onto the recording material 6. At that time, electrostatic attraction of recording material 6 onto the conveying belt 8 is strong due to a voltage applied to the charger for transfer.

While the cyan-toner image is being transferred to the recording material 6 as described above, photosensitive drum 1*b* in the second image forming unit Pb is charged by the charger 15*b*, and a latent image corresponding to a magenta-component color of the original is formed by irradiation from laser-beam scanner 16*b*. A magenta-toner image formed on photosensitive drum 1*b* by developing unit 3*b* is transferred to a predetermined position on the recording material 6 when the recording material 6 on which the image transfer in the first image forming unit Pa has been completed is conveyed to the image forming unit 4*b* having the corona charger 4*b* for transfer by the conveying belt 8.

Subsequently, a yellow-toner image and a black-toner image are formed in the third and fourth image forming units Pc and Pd, respectively, in the same manner as described above. The yellow-toner image and the black-toner image are superimposed onto the predetermined position on the above-described recording material 6 carried by the conveying belt 8.

After the completion of the above-described image forming processes, the respective toner images on the recording material 6 are fused and fixed on the recording material 6 by being heated in a fixing unit 7, and thus a full-color image is obtained. After the completion of the transfer, toner particles remaining on the photosensitive drums 1*a*, 1*b*, 1*c* and 1*d* are removed by the cleaning units 5*a*, 5*b*, 5*c* and 5*d*, respectively, so as to be ready for the next latent image formation.

Figure 1:
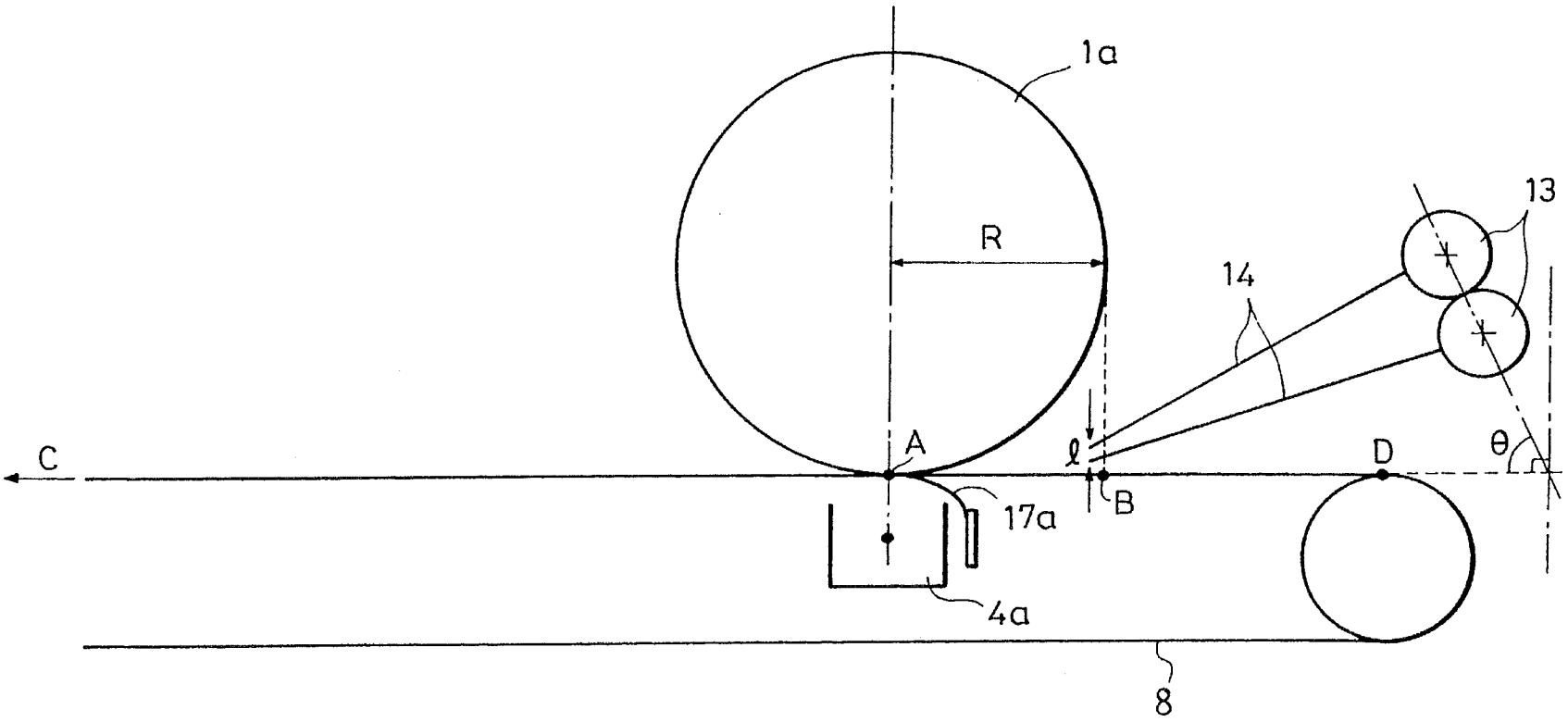
FIGS. 1 and 2 are side cross-sectional views of transfer unit portions of image forming apparatuses according to the present invention.

FIG. 1 is an enlarged view showing the transfer portion (transfer position) of the photosensitive drum 1*a* of the image forming apparatus shown in FIG. 3.

The corona charger 4*a* faces the cylindrical photosensitive drum 1*a* having a radius R (R=40 mm) with the conveying belt 8 interposed between the drum and corona charger. In FIG. 1, point A represents the contact point of the photosensitive drum 1*a* to the conveying belt 8, that is, the transfer position, and point B represents a position on the conveying belt 8 upstream from the transfer position by a distance equal to the radius R of the photosensitive drum 1*a*, the upstream side defined in relation to the direction (represented by arrow C) of conveying the recording material. The recording material is fed by registration rollers 13 from above (from the side of the photosensitive drum 1*a* with respect to the surface of the belt 8 for carrying the recording material) toward the conveying belt 8 to intersect conveying belt 8 on the line segment AB. At that time, by making a downstream-side angle 8, defined by the extended lines connecting the centers of the shafts of a pair of registration rollers 13 and the conveying direction of the conveying belt 8, smaller than 90°, the recording material is conveyed toward the transfer position. Hence, the recording material seldomly jams after passing through the registration rollers 13.

The recording material conveyed by the registration rollers 13 is guided to the conveying belt 8 by a paper-feeding guide 14 made of metal plates, and serving as guide means for guiding the recording material. The opening of the paper-feeding guide 14 at the downstream side in the direction of conveying the recording material may be as narrow as possible. However, if the opening is narrower than about 1.5 mm, the opening may become too narrow due to deflection, deformation or the like because of poor accuracy in production, and the like, causing jamming of the recording material. On the other hand, countermeasures for increasing accuracy, such as increasing the thickness of the plates, or the like, will increase the production cost. Accordingly, the opening is preferably about 1.5–3.0 mm.

As described above, if the recording material is conveyed to a position within a distance equal to the radius of the photosensitive drum upstream of the transfer position, the front end of the recording material is securely conveyed to the contact portion of the photosensitive drum and the conveying belt even if the recording material is curled. Accordingly, insufficient transfer, and bending of the front end of the recording material by the conveying force will not occur. After the first (first-color) transfer to the recording material, the recording material is sufficiently electrostatically attracted to the conveying belt only when transfer electric charges are provided. Hence, when the recording material enters a nip portion between the photosensitive drum and the conveying belt for the second (second-color) transfer, the recording material will not be jammed or bent.

When an attraction charger or the like is not provided before the transfer position, and the charger 4*a* for performing the first transfer also functions as an attraction means for first electrostatically attracting the recording material onto the conveying belt, as in the present embodiment, the recording material is poorly attracted onto the conveying belt before transfer, causing insufficient conveyance. Hence, it is necessary to securely guide the front end of the recording material to the first transfer position. Accordingly, it is desirable to convey the recording material to the above-described position between the points A and B, as shown in FIG. 1, on the conveying belt.

In the present embodiment, it is preferable to guide the recording material to the transfer position after moving the recording material along the conveyor belt 8 before reaching the transfer position, rather than guiding the recording material to bring it into direct contact with the nip between the drum la and the conveyor belt 8. If the recording material is not moved along the belt 8, the front end of the recording material may first contact the photosensitive drum 1*a*, and may disturb the image.

In order to perform image formation on a stable position of the recording material with an adjusted timing, the registration rollers 13 must not develop a slip. Accordingly, in the present embodiment, the pressure of the pair of registration rollers 13 is set relatively strong so as to provide a conveying force which can cope with other paper-feeding rollers and the attraction force of the conveying belt 8. Since more or less errors are produced in apparatuses, a stable conveyance is provided by making the conveying speed of the recording material by the registration rollers 13 slightly greater than the rotation speed of the conveying belt 8. If the conveying speed of the recording material by the registration rollers 13 is less than the rotation speed of the conveying belt 8, the recording material will be pulled from the registration rollers 13, causing disturbance in the image. It is preferred that the above-described conveying speed be greater than the above-described rotation speed by less than 1%, from the viewpoint of producing few color deviation. It is also preferred to provide the front ends of the guide plates 14 (the end portion of the guide plates 14 at the downstream side in the moving direction of the recording material) at positions upstream of the transfer position by less than a distance equal to the radius R of the photosensitive drum 1*a*, that is, within a region formed by the circumferential surface of the photosensitive drum la, the surface (AB) of the belt 8 and the broken line shown in FIG. 1, from the viewpoint of stably guiding the recording material without the front end of the recording material first contacting the drum 1*a*.

Figure 6:
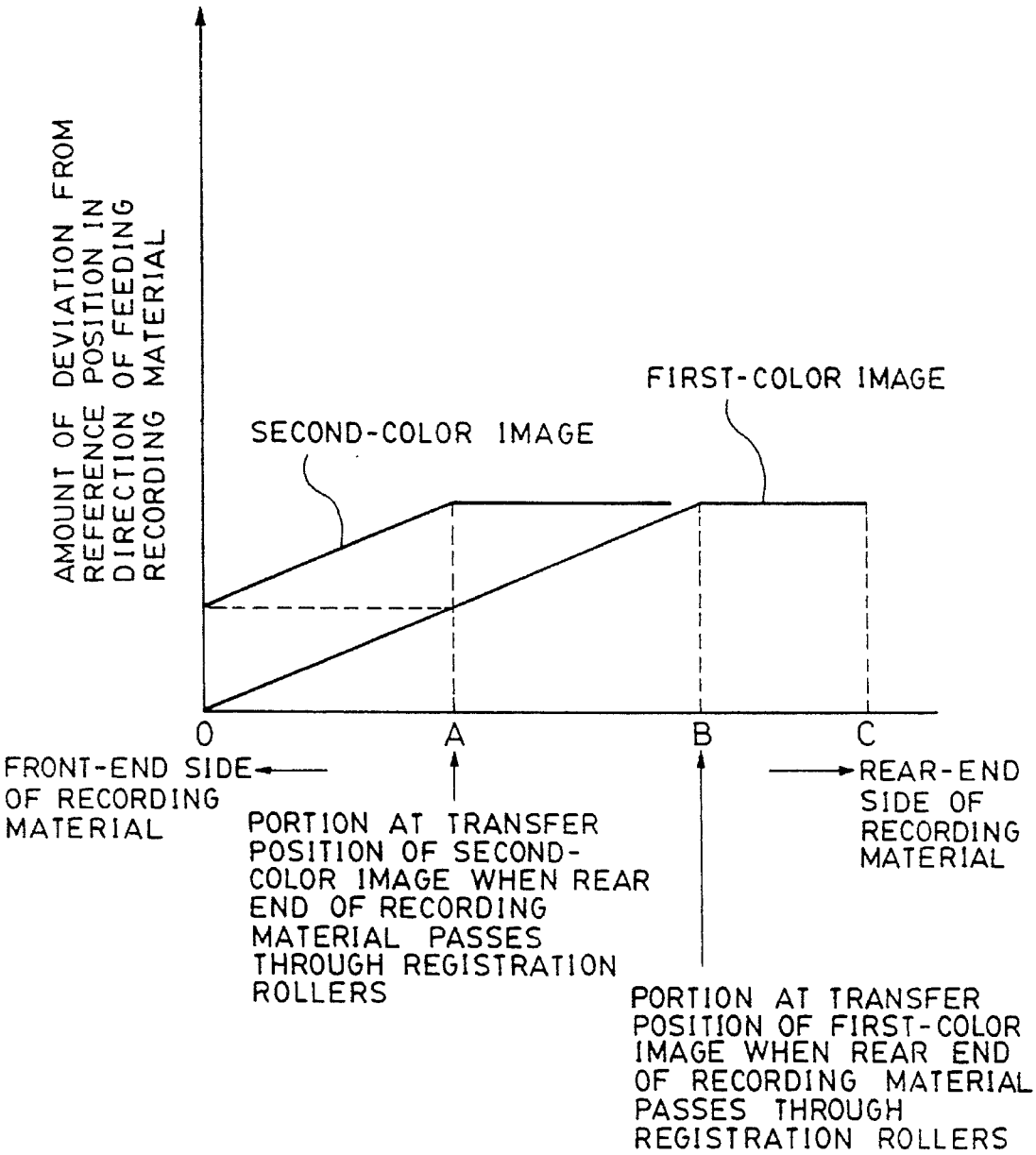
FIG. 6 is a graph illustrating registration deviation.

Suppose, for example, that lines having equal intervals in the moving direction of the recording material are recorded on an image when the conveying speed of the recording material by the registration rollers 13 is greater than the rotation speed of the conveying belt 8. In an extreme case, as shown in FIG. 6, if a recording material (laterally-conveyed A4-size paper) is conveyed by the registration rollers 13, the recording material gradually forms a loop due to a difference in speed between the registration rollers 13 and the conveying belt 8, and the force to push the belt in the conveying direction increases. The amount of deviation is also gradually increased. However, when the rear end of the recording material passes through the registration rollers 13, the force to push the conveying belt 8 in the forward direction disappears, and an ideal positional (reference positional) interval is provided. The deviation is not pronounced in the case of one color. When performing multicolor multiple recording as shown in FIG. 3, however, the second-color image is deviated backward in the conveying direction from the front end of the recording material until a portion at the transfer position of the second-color image when the rear end of the recording material passes through the registration rollers 13 (OA in FIG. 6). This is because a loop is gradually formed in the recording material as described above, and the amount of deviation is gradually increased. The registration (interval) of the second-color image between the portion at the transfer position of the second-color image and a portion at the transfer position of the first-color image (AB in FIG. 6) when the rear end of the recording material passes through the registration rollers 13 is at the ideal reference position, and only the first-color image is deviated backward. The portion between the transfer position of the first-color image when the rear end of the recording material passes through the registration rollers 13, and the rear end of the recording material (BC in FIG. 6) is not deviated, because both the first-color image and the second-color image are deviated by a predetermined amount from the reference position. In the above-described image forming apparatus, any recording material having a size such that the front end of the recording material reaches the transfer position of the second-color image before the rear end of the recording material passes through the registration rollers 13. The above-described registration deviation wherein images are either deviated or superposed is a great factor for deterioration of images when reproducing multicolor images. By first forming a loop in the recording material above the line segment AB on the belt shown in FIG. 1 before the recording material is attracted on the belt, and conveying the recording material to the nip portion while moving the front end of the recording material along the belt, it is possible to reduce the force to push the conveying belt due to the stiffness of the recording material, and to prevent deterioration of the image.

As described above, the recording material is guided in a direction crossing the conveying belt 8 by the guide 14, whereby the recording material does not first contact the drum 1*a* even if a loop is formed. In the present embodiment, as shown in FIG. 1, a pressing member 17*a* for pressing the belt 8 from the side opposite to the drum 1*a* is provided so as to hold the belt 8 in close contact with the drum 1*a* at the transfer position. The pressing member 17*a* is provided in a trailing direction with respect to the moving direction of the belt 8, and comprises a sheet made of polyethylene terephthalate which contacts the belt 8, and a supporting member made of metal for supporting the sheet. By thus providing the pressing member 17*a* at the transfer position, the belt 8 will not be pressed down even if the recording material is conveyed in a direction crossing the belt 8. Furthermore, even if a loop is formed in the recording material as described above, the belt 8 is also prevented from being pressed down by the loop. Accordingly, it is possible to prevent misconveyance of the recording material due to the pressed-down belt 8, and insufficient transfer which tends to occur particularly when the recording material is conveyed between the line segment AB on the belt 8, as described above.

Figure 8:
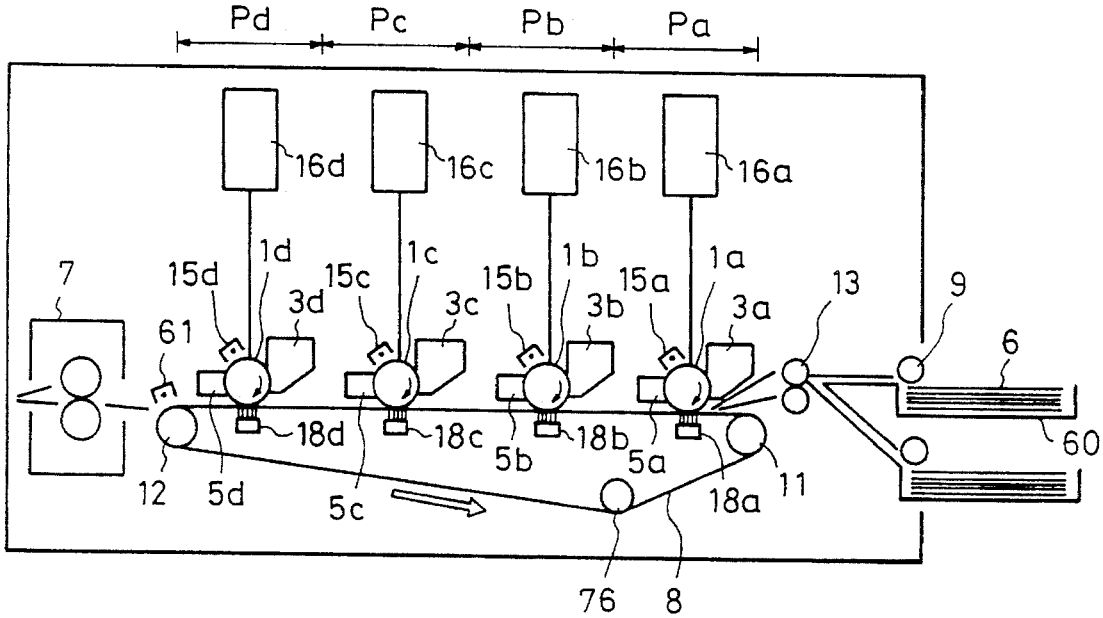

The above-described pressing member may of course be provided at each transfer position of the drums 1*b*, 1*c* and 1*d* in the same manner as in the case of the drum 1*a*. As an alternative to using both a corona charger for transfer and a pressing member, roller-like chargers for transfer may be used because they function both as a corona charger and a pressing member. Another alternative are the brush-like chargers 18*a*, 18*b*, 18*c* and 18*d* shown in FIG. 8, each of which functions as both a corona charger and a pressing member. These approaches are preferred because such chargers can be produced with low cost and they produce less ozone than the corona charger. The roller-like or brush-like chargers are disposed so as to press the belt 8 from the side opposite to the drum in order to bring the belt 8 into close contact with the drums at the transfer positions.

On the other hand, if the recording material is conveyed onto the belt 8 from a direction parallel to the moving direction (represented by arrow C) of the belt 8, the size of the apparatus will be increased in the above-described direction. Hence, this approach is not preferred. Since the difference between the rotation speed of the registration rollers 13 and the rotation speed of the belt 8 functions as a force to push the recording material, causing a stress between the transfer portion (the portion where the paper is attracted) and the registration rollers 13, the shock is greater than when the recording material is fed from above, particularly when a rcording material having strong stiffness is used. Furthermore, if a loop is formed in the recording material as described above, the amount of the loop is greater than in the present embodiment because the distance from the conveying position to the transfer position is increased. Hence, image deviation will be easily produced. In addition, since it is uncertain whether a convex loop is formed or a concave loop is formed, conveyance of the recording material cannot be stabilized.

Figure 2:
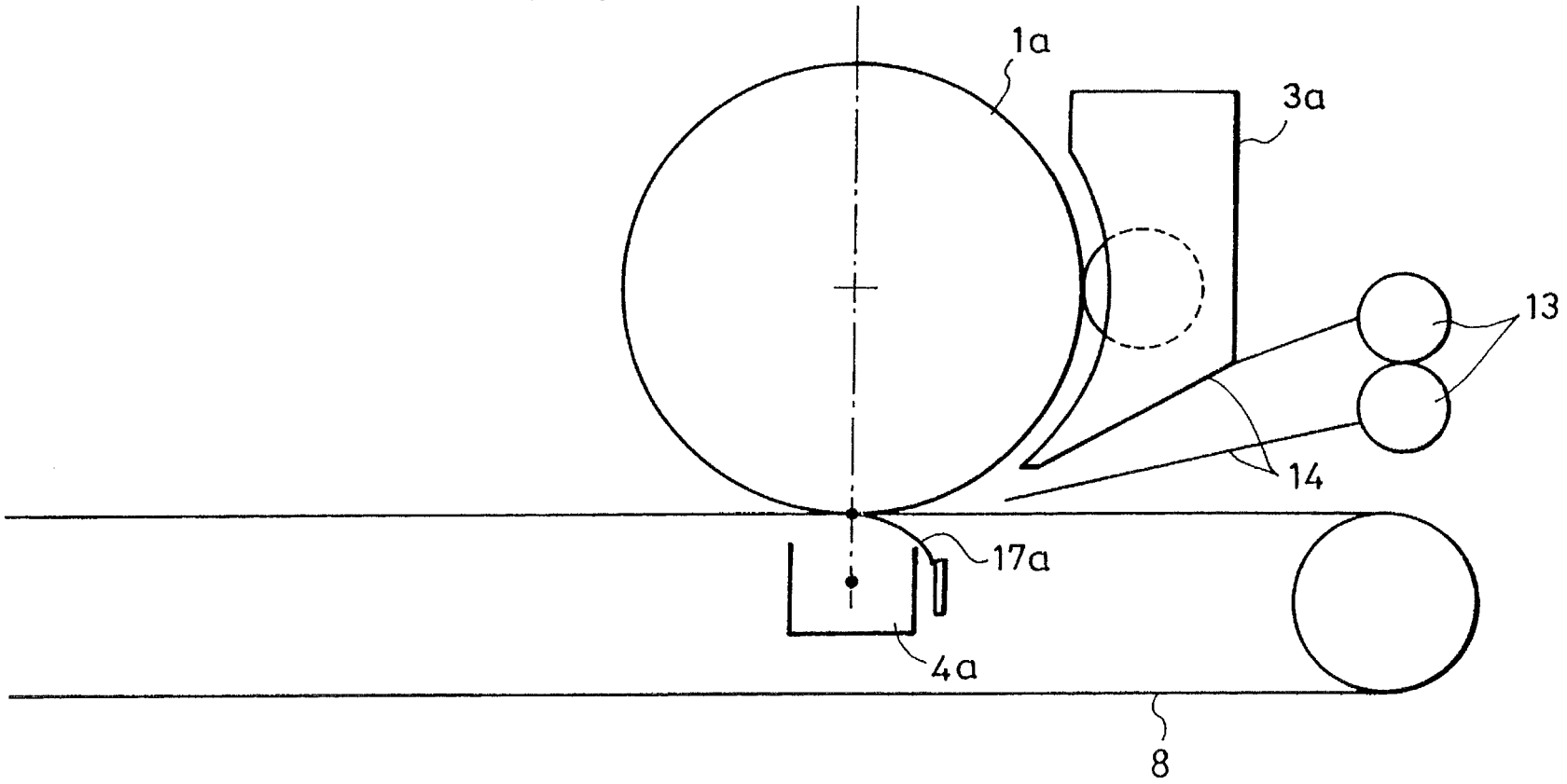
Figure 4:
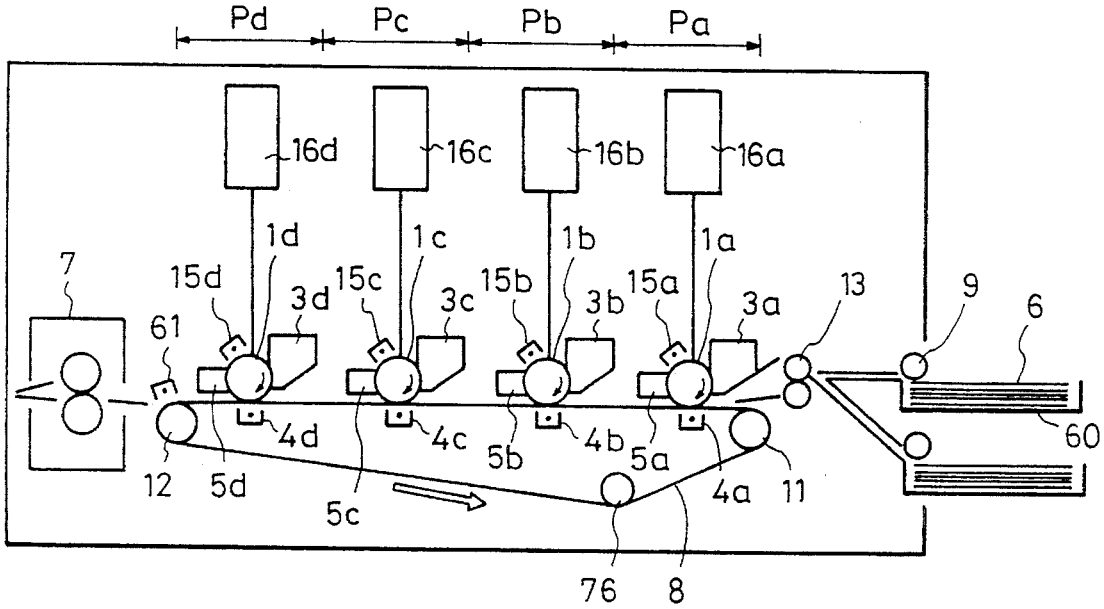

FIG. 4 shows another embodiment of the guiding means used in the image forming apparatus. FIG. 4 is a cross-sectional view of a color printer wherein the cover of the developing unit for the first color developer is also used as the recording-material guide 14. FIG. 2 is an enlarged view of the paper-feeding unit shown in FIG. 4. Thus, in the present embodiment, if the recording material is fed from above at least for the first-color image, an attractive force for the recording material can be obtained by the flow of a current in the transfer of the first-color image. In general, the current in transfer is controlled in accordance with a change in the volume resistance of the recording material, such as paper or the like, due to the hygroscopicity of the recording material. A sufficient attractive force was obtained even in high humidity wherein the electrostatic attractive force is weak.

Figure 7:
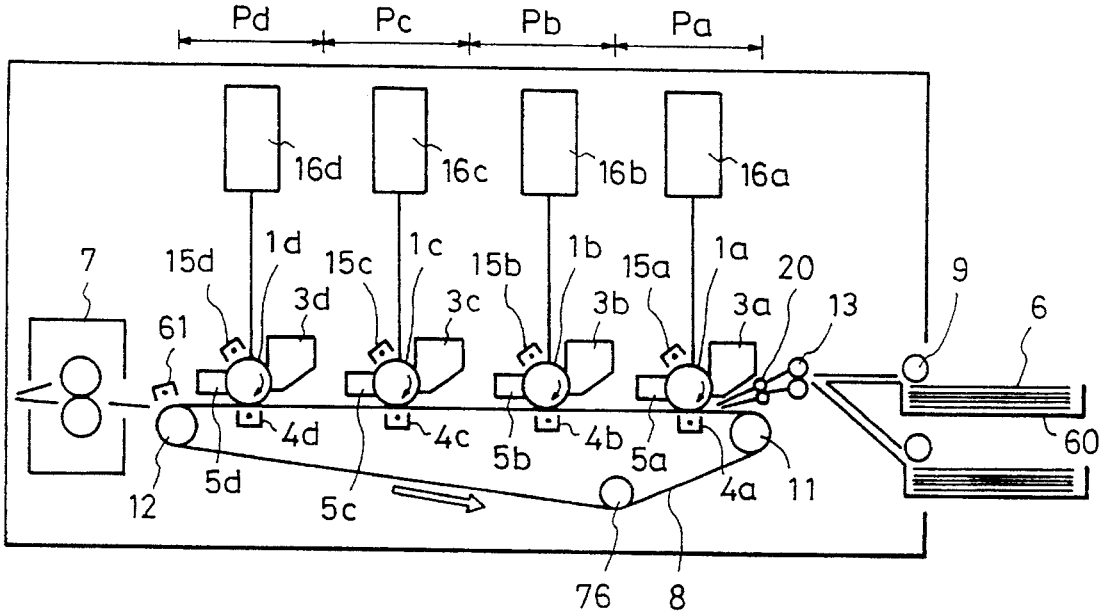

Although, in the foregoing embodiments, an explanation has been provided of the case wherein the registration rollers 13 feed the recording material onto the conveying belt 8, the present invention is not limited to such a case. FIG. 7 illustrates a case wherein a pair of rollers 20 are provided after the registration rollers 13. The object of the registration rollers 13 is to properly start the timing of an image writing operation by laser scanning for the fed recording material when the laser irradiates a light beam onto the drum in accordance with an image signal. Hence, in the printer having the configuration shown in FIG. 7, the registration rollers 13 cannot be brought closer to the transfer position than the semicircle of the drum (from the exposure position to the transfer position of the photosensitive drum). Accordingly, in order to be able to record on a small-size recording material, such as a post card, a visiting card or the like, the above-described rollers 20 may be provided.

When the recording material was conveyed onto a position (BD in FIG. 1) on the conveying belt 8 farther than the position within the radius R of the photosensitive drum at the upstream side in the moving direction of the conveying belt 8 from the transfer position, misconveyance and insufficient transfer of the recording material frequently occurred.

As explained above, according to the present invention, image deviation can be reduced. The present invention also has the effect of providing stable conveyance without disturbance in images on the image bearing members due to contact of the front end of a recording material, particularly of a curled recording material, with the image bearing members.

While the present invention has been described with respect to what is presently considered to be the preferred embodiments, it is understood that the invention is not limited to the disclosed embodiments. The present inventin is intended to cover various modifications and equivalent arrangements included within the spirit and scope of the appended claims.

What is claimed is:

1. An image forming apparatus comprising:

a cylindrical image bearing member, said member having a radius R;

image forming means for forming an image on said image bearing member;

transfer means for performing a first image transfer of the image on said image bearing member to a recording material at a first transfer position;

movable recording material carrying means for transporting the recording material to said first transfer position for performance of said first image transfer, said recording material carrying means further transporting the recording material to a second transfer position for performance of a second image transfer to the recording material after said first image transfer; and conveying means for conveying the recording material to said recording material carrying means, the recording material being first conveyed by said conveying means to a position upstream of said first transfer position in relation to a moving direction of said recording material carrying means and within the distance radius R as measured from said first transfer position on a surface of said recording material carrying means facing the image bearing member, the moving direction of said surface crossing the conveying direction of the recording material conveyed by said conveying means, wherein the recording material is first electrostatically attracted to said recording material conveying means by said transfer means.

2. An image forming apparatus according to claim 1, further comprising a second image bearing member, second image forming means for forming an image on said second image bearing means, and second transfer means for performing said second image transfer of the image on said second image bearing member to the recording material at said second transfer position.

3. An image forming apparatus according to claim 1 or 2, wherein said first and second images have different colors.

4. An image forming apparatus according to claim 1, wherein a conveying speed of the recording material conveyed by said transporting means is greater than a conveying speed of the recording material transported by said recording material carrying means.

5. An image forming apparatus according to claim 1 or 2, wherein said recording material carrying means is pressed at said first transfer position from a side opposite to said image bearing member.

6. An image forming apparatus according to claim 5, further comprising pressing means for pressing said recording material carrying means at said first transfer position from the side opposite to said image bearing member.

7. An image forming apparatus according to claim 1, further comprising guiding means for guiding the recording material conveyed by said conveying means to said recording material carrying means, said guiding means being provided at a position upstream of said first transfer position in relation to a moving direction of said recording material carrying means and within the radius R from said first transfer position.

8. An image forming apparatus according to claim 1, wherein said conveying means comprises a pair of rotating members, and wherein an angle defined by a first extended line connecting the centers of the shafts of the rotating members and a second extended line of an upstream surface of the recording material carrying means is smaller than 90°.

9. An image forming apparatus according to claim 3, wherein a full-color image is formed on said recording material.

10. An image forming apparatus according to any of claims 1, 2, 4, 7 and 8, wherein said recording material carrying means has a belt-like shape.

11. An image forming apparatus according to claim 5, wherein said recording material carrying means has a belt-like shape.

12. An image forming apparatus according to claim 1, wherein said transfer means electrostatically transfers the image on said image bearing member to the recording material.

13. An image forming apparatus according to claim 12, wherein said transfer means attracts the recording material onto said recording material carrying means before performing said first image transfer.

14. An image forming apparatus comprising:

a cylindrical image bearing member, said member having a radius R;

image forming means for forming an image on said image bearing member;

transfer means for performing image transfer of the image on said image bearing member to a recording material at a transfer position;

movable recording material carrying means transporting the recording material to said transfer position to perform said image transfer; and conveying means for conveying the recording material to said recording material carrying means, the recording material being first conveyed by said conveying means to a position upstream of said transfer position in relation to a moving direction of said recording material carrying means and within the distance radius R as measured from said transfer position on a surface of said recording material carrying means facing the image bearing member, the moving direction of said surface crossing the conveying direction of the recording material conveyed by said conveying means; and pressing means for pressing said recording material carrying means in the vicinity of said transfer position in order to prevent the recording material from pushing to move said recording material carrying means on conveying the recording material by said conveying means.

15. An image forming apparatus according to claim 14, wherein a conveying speed of the recording material conveyed by said transporting means is greater than a conveying speed of the recording material transported by said recording material carrying means.

16. An image forming apparatus according to claim 14, wherein said transfer means presses said recording material carrying means at said transfer position from the side opposite to said image bearing member.

17. An image forming apparatus according to claim 14, further comprising guiding means for guiding the recording material conveyed by said conveying means to said recording material carrying means, said guiding means being provided at a position upstream of said transfer position in relation to a moving direction of said recording material carrying means and within the radius R from said transfer position.

18. An image forming apparatus according to claim 14, wherein said conveying means comprises a pair of rotating members, and wherein an angle defined by a first extended line connecting the centers of the shafts of the rotating members and a second extended line of an upper surface of the recording material carrying means is smaller than 90°.

19. An image forming apparatus according to any of claims 14, 15, 16, 17 and 18, wherein said recording material carrying means has a belt-like shape.

20. An image forming apparatus according to claim 14, wherein said transfer means electrostatically transfers the image on said image bearing member to the recording material.

21. An image forming apparatus according to claim 20, wherein said transfer means first attracts electrically the recording material to said recording material carrying means.

22. An image forming apparatus according to claim 6, wherein said recording material carrying means has a belt-like shape.

* * * * *

UNITED STATES PATENT AND TRADEMARK OFFICE

CERTIFICATE OF CORRECTION

PATENT NO. : 5,455,663
DATED : October 3, 1995
INVENTOR(S) : MASAHIRO INOUE, ET AL.

It is certified that error appears in the above-indentified patent and that said Letters Patent is hereby corrected as shown below:

Column 1,
line 10, "Title" should read --Field--.
Column 4,
line 53, "unit 4b" should read --unit Pb--.
Column 5,
line 23, "angle 8," should read --angle θ,--.
Column 9,
line 1, "inventin" should read --invention--; and
line 39, "means," should read --member,--.
Column 12,
line 4, "electrically" should read --electrostatically--.

Signed and Sealed this

Twelfth Day of March, 1996

Bruce Lehman

*Attest:*

BRUCE LEHMAN

*Attesting Officer*

*Commissioner of Patents and Trademarks*